US009016404B2

(12) United States Patent
Püttmann

(10) Patent No.: US 9,016,404 B2
(45) Date of Patent: Apr. 28, 2015

(54) RAM BORING DEVICE

(75) Inventor: Franz-Josef Püttmann, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 412 days.

(21) Appl. No.: 13/391,989

(22) PCT Filed: Aug. 20, 2010

(86) PCT No.: PCT/EP2010/005132

§ 371 (c)(1), (2), (4) Date: May 7, 2012

(87) PCT Pub. No.: WO2011/023341

PCT Pub. Date: Mar. 3, 2011

(65) Prior Publication Data

US 2012/0228031 A1 Sep. 13, 2012

(30) Foreign Application Priority Data

Aug. 24, 2009 (DE) ..... 10 2009 038 383

(51) Int. Cl.
*E21B 1/02* (2006.01)
*E21B 4/14* (2006.01)
*E21B 4/06* (2006.01)

(52) U.S. Cl.
CPC ... *E21B 4/06* (2013.01); *E21B 4/14* (2013.01); *E21B 4/145* (2013.01)

(58) Field of Classification Search
CPC ..... E21B 11/02; E21B 4/14; E21B 4/06; E21B 1/00; E21B 1/02
USPC ..... 175/293, 296, 297, 19; 173/115, 13, 19, 173/17
See application file for complete search history.

(56) References Cited

U.S. PATENT DOCUMENTS

| | | | | | |
|---|---|---|---|---|---|
| 3,193,024 | A | * | 7/1965 | Cleary | 173/17 |
| 3,727,701 | A | * | 4/1973 | Sudnishnikov et al. | 173/91 |
| 3,924,690 | A | * | 12/1975 | Shaw | 173/13 |
| 4,250,972 | A | * | 2/1981 | Schmidt | 173/91 |
| 4,509,606 | A | | 4/1985 | Willis | |
| 4,708,211 | A | * | 11/1987 | Shemyakin et al. | 175/19 |
| 4,833,563 | A | | 5/1989 | Russell | |
| 4,833,974 | A | | 5/1989 | Schmidt | |
| 5,148,878 | A | * | 9/1992 | Schmidt et al. | 175/296 |
| 5,318,140 | A | * | 6/1994 | Ekwall et al. | 175/296 |
| 5,350,023 | A | | 9/1994 | Klemm | |
| 5,494,116 | A | * | 2/1996 | Wentworth | 173/17 |
| 5,564,510 | A | | 10/1996 | Walter | |
| 5,960,892 | A | | 10/1999 | Balve et al. | |
| 6,371,220 | B1 | | 4/2002 | Hesse et al. | |

(Continued)

FOREIGN PATENT DOCUMENTS

| | | |
|---|---|---|
| DE | 39 09 567 A1 | 9/1990 |
| DE | 41 34 917 C1 | 4/1993 |

(Continued)

*Primary Examiner* — Kenneth L Thompson
(74) *Attorney, Agent, or Firm* — Howard IP Law Group, PC

(57) ABSTRACT

The invention relates to a ram boring device for creating horizontal boreholes, having an impact piston which moves in an oscillatory manner within a casing of the ram boring device and of which the impact frequency or impact intensity can be varied by displacing the center position of the impact piston inside the casing.

15 Claims, 5 Drawing Sheets

(56) References Cited

U.S. PATENT DOCUMENTS

| | | | |
|---|---|---|---|
| 7,347,287 | B2 | 3/2008 | Chancey |
| 7,874,382 | B2 | 1/2011 | Püttmann et al. |
| 7,938,205 | B2 | 5/2011 | Püttmann |
| 7,954,565 | B2 | 6/2011 | Püttmann |
| 2006/0110219 | A1 | 5/2006 | Püttmann |
| 2008/0245573 | A1 | 10/2008 | Püttmann |
| 2008/0257609 | A1 | 10/2008 | Püttmann et al. |
| 2009/0003935 | A1 | 1/2009 | Püttmann |
| 2009/0211812 | A1 | 8/2009 | Püttmann |
| 2009/0255701 | A1 | 10/2009 | Püttmann et al. |
| 2010/0150643 | A1 | 6/2010 | Püttmann |
| 2010/0196089 | A1 | 8/2010 | Püttmann |
| 2010/0252228 | A1 | 10/2010 | Püttmann |
| 2010/0282517 | A1 | 11/2010 | Püttmann |
| 2011/0123292 | A1 | 5/2011 | Püttmann |
| 2011/0209920 | A1 | 9/2011 | Püttmann |

FOREIGN PATENT DOCUMENTS

| | | | |
|---|---|---|---|
| DE | 195 30 972 | A1 | 2/1997 |
| DE | 195 48 835 | C1 | 4/1997 |
| DE | 198 58 519 | A1 | 6/2000 |
| DE | 100 34 471 | A1 | 1/2002 |
| DE | 10 2006 010227 | A1 | 9/2007 |
| EP | 0 154 778 | | 9/1985 |
| EP | 0658681 | A2 | 9/1990 |
| RU | 1081340 | A1 | 6/2000 |
| WO | WO 9941483 | A1 | 9/2007 |

* cited by examiner

RAM BORING DEVICE

CROSS-REFERENCES TO RELATED APPLICATIONS

This application is the U.S. National Stage of International Application No. PCT/EP2010/005132, filed Aug. 20, 2010, which designated the United States and has been published as International Publication No. WO 2011/023341 and which claims the priority of German Patent Application, Serial No. 10 2009 038 383.2, filed Aug. 24, 2009, pursuant to 35 U.S.C. 119(a)-(d).

BACKGROUND OF THE INVENTION

The invention relates to a ram boring device for creating horizontal boreholes and to a method for operating a corresponding ram boring device.

Ram boring devices of this type are known in the art and are used, in particular, to create horizontal boreholes in the ground. Typically, such ram boring device has an impact piston which moves in an oscillatory fashion (back and forth) inside the casing and thereby strikes a front or rear impact face of the casing depending on the desired movement direction of the ram boring device. The transferred kinetic energy of the impact piston causes an acceleration of the ram boring device in the soil.

Such ram boring device is disclosed, for example, in U.S. Pat. No. 5,148,878 A. The ram boring device disclosed therein includes a control tube which movably supports an impact piston. The rear end of the control tube is fixedly connected with a compressed air supply; the control tube is also connected via a pretensioned coil spring with a component affixed to the housing to enable both longitudinal axial and rotational movement. The spring force urges the control tube into a forward position (advance position) and locks the control tube in this position by a quarter turn in a locking groove. The device is reversed by unlocking the control tube by rotating the compressed air supply by a quarter turn against the spring bias, whereby the control tube is moved into a rear position (return position) by the effect of the compressed air and opposite the longitudinal axial spring force. At the same time, the center position of the impact piston is displaced inside the casing, causing the impact piston to strike a rear impact face in the return position. Like in the forward position, the control tube is in the return position locked in a second locking groove through the effect of the rotationally-biased spring. With another quarter turn of the control tube, the ram boring device is again reversed into the advance position, wherein the level of the pressure of the supplied compressed air is simultaneously reduced, causing the forces produced by the pretensioned spring to exceed the pressure forces and thus moving the control tube again into the forward position.

The device in U.S. Pat. No. 5,148,878 A thus discloses two operating positions, in which either a front or a rear impact face of the casing is struck.

It is the object of the invention to improve a ram boring device so that the impact frequency and/or the impact intensity can be influenced.

SUMMARY OF THE INVENTION

According to the invention, a ram boring device for creating horizontal boreholes includes a casing having impact faces, an impact piston which is set in an oscillatory motion by a pressurized fluid and transfers kinetic energy to at least one of impact faces. The ram boring device is equipped with a device that allows displacement of the center position of the impact piston such that the frequency of the movement of the impact piston and/or the impact intensity is varied.

The term "ram boring device" refers to a device which is moved intermittently in an existing passage or in a passage to be created, in order to create or widen a borehole, or to replace or clean an existing pipe with or without destroying the pipe, to pull lines into existing pipes or other elongated bodies, as well as to all devices for construction work of underground propulsion.

The ram boring device within the context of the invention is not limited to underground excavation work. For example, lines in which an earth boring device is operated may also be located above ground.

The term "horizontal borehole" within the context of the present invention includes, in particular, any type of existing passages or passages to be created, in particular horizontal passages in a body, in particular in-ground passages including in-ground boreholes, rock boreholes or in-ground lines, as well as underground or above ground pipes and drainage channels, which can be produced, widened, destroyed, cut open or cleaned by using a suitable ram boring device.

The term "center position" of the impact piston within the context of the invention refers to the position located midway between the two reversal points of the oscillatory movement of the impact piston.

According to an advantageous embodiment of the device according to the invention, the device has in addition to the casing and an impact piston which is set into an oscillatory motion inside the housing by a supplied pressurized fluid, such as a gas or a liquid, also a control bushing which is movably arranged inside the impact piston. Additionally, the impact piston is characterized by at least one control opening disposed in its envelope, wherein the position of the control opening before, over and behind the control bushing causes the alternating aeration and venting of a pressure chamber arranged between the casing and the impact piston. The center position of the impact piston can be moved through a change in length (elongation, shortening) of the control bushing and/or by displacing the position of the control bushing inside the casing.

One possibility to change the position of the control bushing may involve connecting the control bushing on the rear side, i.e., in the direction of the connection for a pressurized fluid supply, with a guide bushing which itself is either elongated/shortened or displaced inside the casing, so as to displace the center position of the impact piston according to the invention by way of the connection with the control bushing.

In an alternative embodiment, the position of the control bushing can also be changed by moving the control bushing with the connecting element relative to the guide bushing.

With the invention, the "control bushing" or the "guide bushing" need not have a tubular shape; instead, any shape providing the intended function is possible.

A control bushing or guide bushing having a changeable length may have at least two partial bushings which can move with respect to one another at least in the longitudinal axial direction and which define with their relative position the length of the control bushing or guide bushing. Preferably, the partial bushings are constructed so that one of the partial bushings is slidingly supported on the other partial bushing. The second partial bushing may have a section with a reduced outside diameter which substantially corresponds to the inside diameter of the first partial bushing.

Advantageously, a device for adjusting the relative mutual position of the two partial bushings may be provided. This may allow the adjustment in both directions (shortening or the lengthening the control or guide bushing) or only in one direction. In the second case, elastic means are preferably arranged between the two partial bushings for generating a return force opposing the adjustment force of the device. However, the elastic means may, for example, also be arranged on the opposite side of one or both partial bushings and generate a corresponding force that moves the two partial bushings towards each other or away from each other. In particular preferred embodiment, the device also allows a relative adjustment of the two partial bushings during the impact operation.

The operation of the adjustment device may be based on different physical principles. In particular, the adjustment force may be produced by hydraulic, pneumatic or magnetic means. The adjustment may also be purely mechanical, for example via a driven relative rotation in conjunction with a threaded connection of the two partial bushings. The aforementioned adjustment possibilities may also be combined.

Preferably, the control bushing or guide bushing having a changeable length may be constructed and/or attached so that a length change of the control bushing only causes a displacement of the edge of the bushing that faces away from the struck impact face of the casing. The edge of the control bushing located on the side of the impact face of the casing is thus fixedly arranged inside the casing (in an operating position (forward/backward) of the ram boring device).

A device according to the invention for moving the position of the control bushing or guide bushing inside the casing preferably includes a control tube extending at least in a section inside the control or guide bushing for movement thereto at least in a longitudinal axial direction. A control tube which is movable with respect to the control bushing is hereby preferably fixedly connected with the casing.

In a preferred embodiment of the present invention, wherein the control tube (at least in the longitudinal axial direction) is connected with the control bushing and movably supported inside the guide bushing, whereby a displacement of the control tube relative to the guide bushing causes a displacement of the control bushing, the relative position of the control tube in the guide bushing can be locked in several positions, thereby creating differently defined operating positions.

In addition, the control tube may advantageously be pretensioned with respect to the guide bushing by elastic means both in the longitudinal axial direction as well as in the rotation direction, wherein the pretension in the longitudinal axial direction causes a forward displacement of the control bushing inside the housing, i.e. towards the advance position, and the pretension in the rotation direction causes (at least) one locking element to lock in a corresponding undercut; the latter fixes the relative position of the control tube in relation to the guide bushing. For example, the locking element may be formed as a protrusion disposed on the control tube which can be rotated into a corresponding recess in the guide bushing.

Relative movement of the control bushing or guide bushing with respect to the control tube may also be produced by forming a pressure chamber from the combination of the control tube and the control bushing or guide bushing, wherein the size of the pressure chamber is defined by the relative position of the two components with respect to one another. For example, the outside surface of the guide tube and the inside surface of the control bushing or guide bushing may, in conjunction with suitably arranged ring-shaped edges, form a ring-shaped pressure chamber that is filled with a pressurized fluid. To fix or vary the size of the pressure chamber, the pressure of the fluid may be varied as a function of the outside pressure or of another counterforce, for example a spring force.

It will be understood that the pressure chamber may have any other arbitrary shape aside from a ring shape. In particular, the pressure chamber may be formed only by a partial circle of the outside and/or the inside circumference of the guide tube or the control bushing or guide bushing.

The dimensions of the pressure chamber define, by way of the position of the edges of the control bushing, the center position of the oscillating impact piston inside the casing. Displacement or lengthening/shortening of the control bushing inside the casing causes the center position of the impact piston to also be displaced. In this way, the impact frequency of the impact piston can be changed and simultaneously the impact intensity can be affected.

In one embodiment, pressurized fluid may be supplied to the pressure chamber with via an additional line extending, for example, inside the control tube. The pressurized fluid may in this case be compressed air, which is preferably also used as drive medium for the impact piston and preferably transported into the interior of piston through the control tube. In another embodiment, a pressurized fluid may be supplied. For example, this fluid may simultaneously be introduced into the soil in the region of the drill head or at another location for promoting progress in the ground. In these cases, drilling fluids may be used which can be adapted to the prevailing drilling conditions through admixture of additives.

Preferably, the length and/or the position of the control bushing or guide bushing may be changed continuously in a predefined adjustment range. In this way, the impact frequency/intensity can be particularly well adapted to the prevailing drilling conditions. At the same time, a plurality of positions within the adjustment range can be defined to allow a step-wise adjustment.

In an alternative embodiment, a ram boring device according to the invention may include a control bushing which is movably arranged inside the impact piston, and at least two control openings disposed in the envelope of the impact piston, wherein a pressure chamber disposed between the casing and the impact piston is aerated and vented by alternatingly positioning the control openings in front of and behind the control bushing. In this embodiment, the at least two control openings are mutually offset in the longitudinal direction of the impact piston.

With a device for covering and uncovering one of the control openings as needed, a specific opening may be responsible for aerating and venting the pressure chamber. Due to the distance between the control openings in the longitudinal direction of the impact piston, covering and uncovering of individual control openings may produce different impact strokes of the impact piston.

Preferably, the impact piston is hereby constructed in two parts, for example with an additional (partial) bushing which is movably arranged inside the (remaining) impact piston and which causes one or several of the control openings to be uncovered or covered by a defined rotation and/or translation inside the (remaining) impact piston.

With the device according to the invention, a ram boring device of the aforedescribed type can be operated so that the frequency of the movement of the impact piston and/or the impact intensity may be varied by displacing the center position of the impact piston. In this way, both the frequency and the intensity of the impact strikes may be adapted to the prevailing soil conditions. In a particular advantageous embodiment, this may be done during an ongoing drilling operation.

BRIEF DESCRIPTION OF THE DRAWING

The invention will now be described in more detail with reference to an exemplary embodiment illustrated in the drawings, which show in.

DETAILED DESCRIPTION OF PREFERRED EMBODIMENTS

Figure 1:
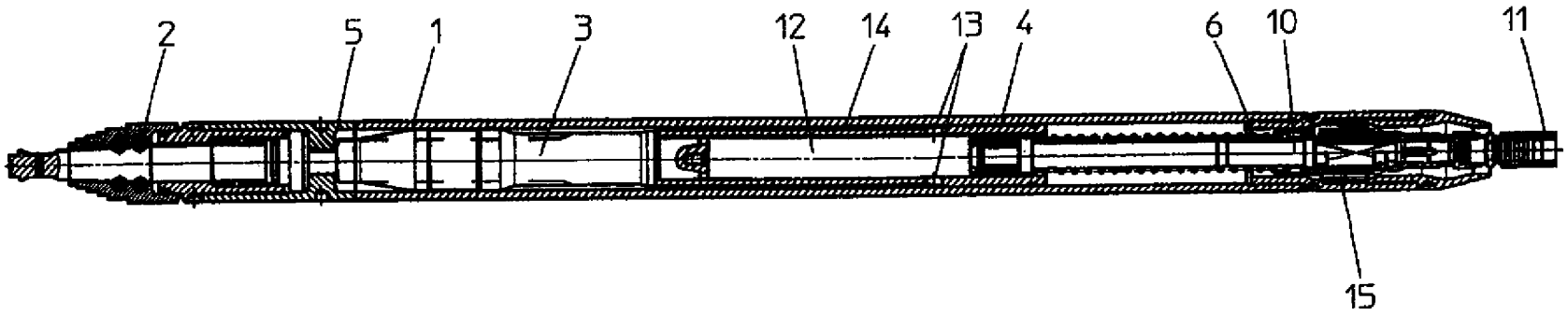
FIG. 1 a cross-sectional side view of a ram boring device according to the invention in a first embodiment.

The embodiment illustrated in FIG. 1 of a ram boring device according to the invention includes essentially a casing 1 and a drill head 2 screwed into the casing 1. An impact piston 3 moves back and forth inside the casing 1 under the effect of compressed air, wherein the impact piston 3 strikes within each cycle, depending on the position of a control bushing 4, either a front impact face 5 or a rear impact face 6.

Figure 2:
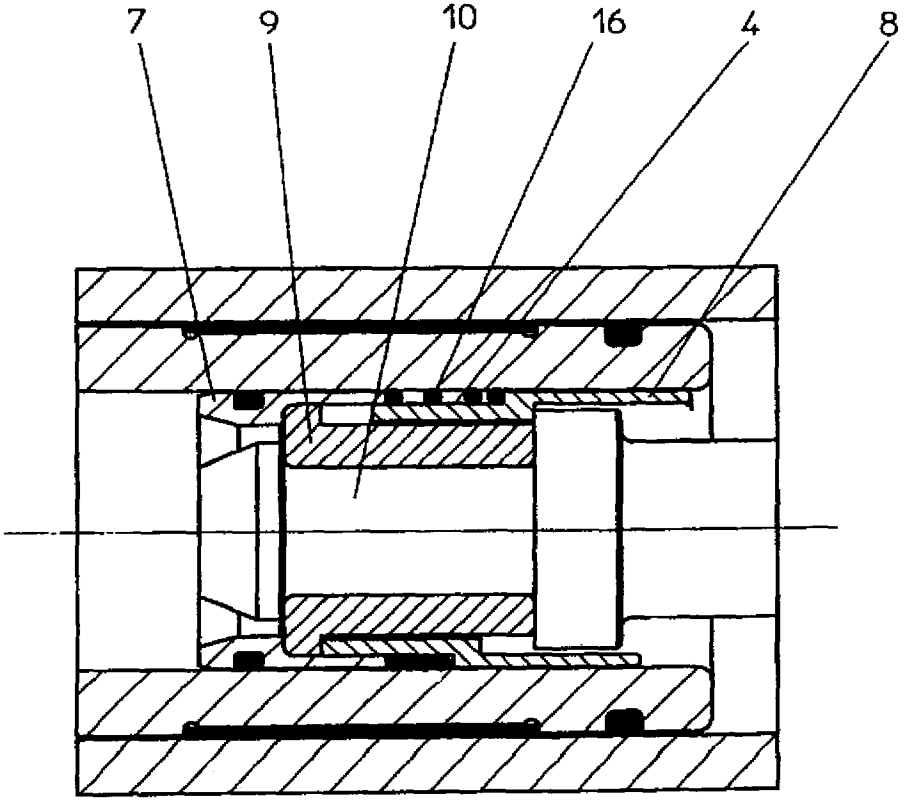
FIG. 2 a detailed view of the control bushing of FIG. 1, including the adjacent components.

As illustrated in particular in FIG. 2, the control bushing 4 is composed of two partial bushings 7, 8. The partial bushing 8 illustrated on the right-hand side of FIG. 2 has a section with a reduced outside diameter which substantially corresponds to the inside diameter of the left partial bushing 7. The sleeve 4 is connected via an intermediate element 9 with a control tube 10 which is in turn displaceable inside the casing in the longitudinal axial direction for reversing the movement direction of the ram boring device and which can be fixed in two positions—one for the advance and one for the return of the device. The reversal occurs hereby in exactly the same manner as described, for example, in the introductory section of the description of the ram boring device disclosed in U.S. Pat. No. 5,148,878 A.

For operating the ram boring device, compressed air is supplied into the pressure chamber 12 of the impact piston 3 through a compressed air hose 11 which is connected with the rear end of the hollow control tube 10. In the illustrated position of the impact piston, pressure between the pressure chamber 12 and the pressure chamber 14 formed by the outside surface of the impact piston 3 and the inside surface of the casing 1 is equilibrated through the control openings 13. Due to the larger effective surface area of the pressure chamber 14 compared to the pressure chamber 12, the resulting pressure force causes a return motion of the impact piston 3.

As soon as the control openings 13 completely traverse the front (left) edge of the control bushing 4, pressure equilibration between the pressure chamber 12 and the pressure chamber 14 stops. Although the increase in size of the pressure chamber 14 causes a steady pressure decrease in the pressure chamber 14 during the return motion, the impact piston 3 moves—due to its inertia—back until the control openings 13 traverse the rear (right) edge of the control bushing 4. Thereafter, pressure is equilibrated between the pressure chamber 14 and atmosphere outside the drilling device through the control openings 13 and the vent openings 15.

After the overpressure in the pressure chamber 14 has relaxed, the (forward oriented) pressure force generated by the pressure chamber 12 causes the impact piston 3 to decelerate and thereafter accelerate in the opposite direction, i.e., in the forward direction towards the drill head. The initiated forward stroke is terminated when the impact piston 3 strikes the front impact face 5. The control openings 13 have then already traversed the front (left) edge of the control bushing 4, starting a new work cycle.

The length of the control bushing 4, which consists of the partial bushings 7 and 8, can be changed with an (unillustrated) adjustment device, wherein the adjustment device causes the bushing 4 to telescope against the spring force of the coil spring 16 and thus become shorter.

The front partial bushing 7 is fixedly connected with the control tube 10 in the longitudinal axial direction, so that a change in the length of the bushing does not cause a change in the position of the front control edge. Depending on the length of the bushing 4, the control openings 13 then traverse the rear control edges of the bushing 4 at different positions inside the housing, i.e. the longer the control bushing 4 is, the later the movement direction of the control piston reverses, forcing the control piston to travel a longer distance from the rear reversal point to the front impact face 5. This reduces the impact frequency of the piston. However, at the same time the longer distance to the impact face 5 causes a longer acceleration of the impact piston 3, so that the velocity and hence the kinetic energy, when the impact piston 3 strikes the impact face 5, is greater than with a short control bushing 4. As a result, the impact intensity is increased.

Figure 3:
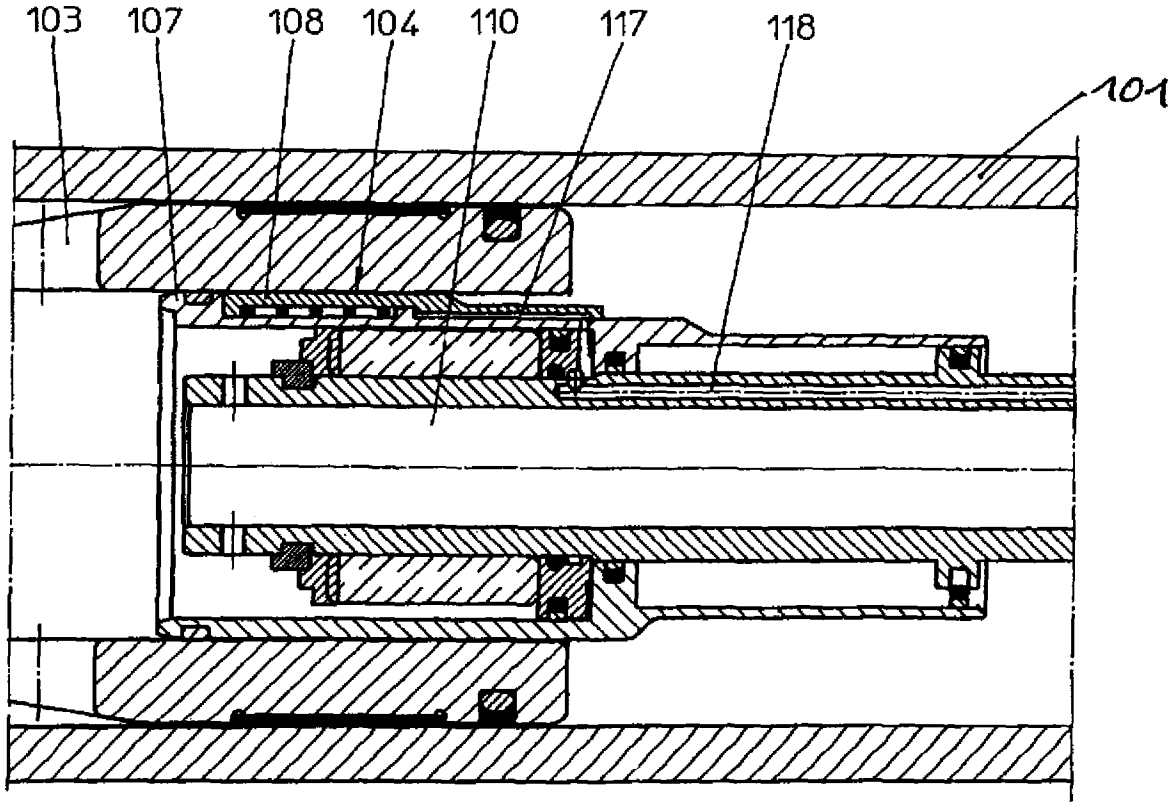
FIG. 3 a detail of a ram boring device according to the invention in a second embodiment.

FIG. 3 shows an alternative embodiment of a control bushing 104 with an adjustable length. The control bushing 104 may be used in a ram boring device according to FIG. 1 instead of the control bushing 4 illustrated in FIG. 2. The control bushing 104 of FIG. 3 is also composed of a front partial bushing 107 and a rear partial bushing 108. These partial bushings 107, 108 form a pressure chamber 117 which can be supplied with a pressure fluid via a pressure fluid line 118 extending inside a section of the wall of the control tube 110. By increasing the pressure in the pressure chamber 117, the rear partial bushing 108 is moved towards the rear end of a ram boring device (in FIG. 3 to the right), thereby lengthening the overall length of the control bushing formed of the two partial bushings 107 and 108 and—because they front partial bushing 107 is fixedly connected with the control tube 110—displacing the rear control edge of the control bushing 104 rearward; reversal of the movement direction of the impact piston 103 inside the housing 101 is thereby delayed. Displacement of the rear partial bushing 108 causes compression of a spring arranged between the partial bushings 107, 108, thereby increasing its pretension. When the pressure in the pressure chamber 117 is reduced further, this pretension causes a further reduction in the overall length of the control bushing 104.

Figure 4:
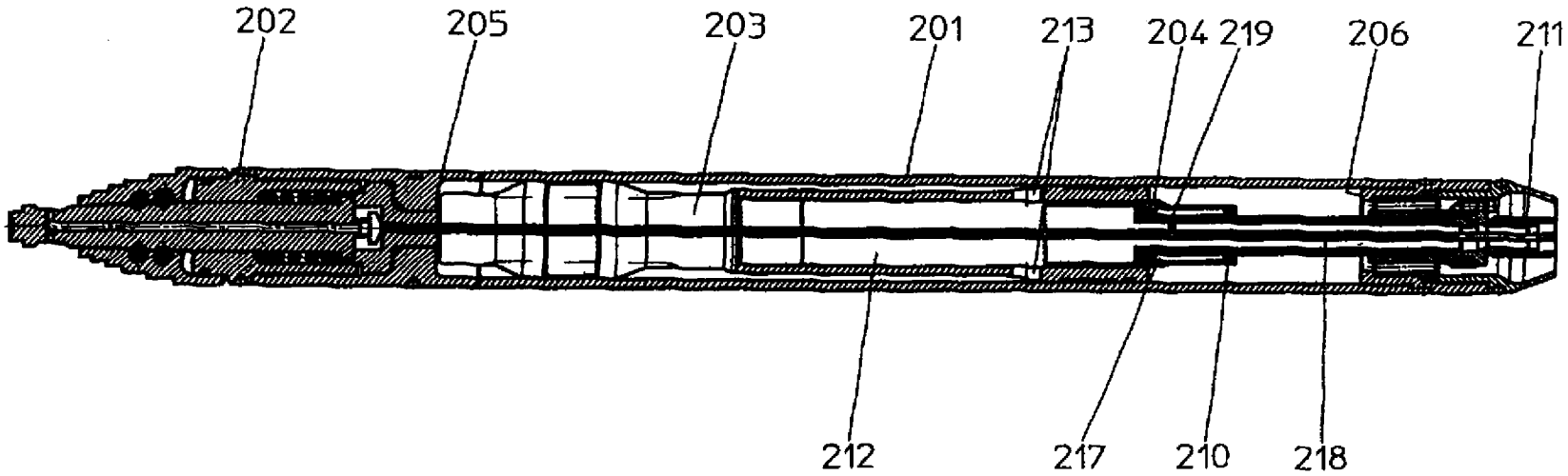
FIG. 4 a cross-sectional side view of a ram boring device according to the invention in a third embodiment.

The ram boring device illustrated in FIG. 4 is designed to change the impact frequency and/or the impact intensity by displacing the relative position of the control bushing inside the housing 201. A small displacement of the fixed-length control bushing 204 changes the impact frequency and/or the impact intensity, whereas a larger displacement causes the movement direction of the ram boring device to reverse, because the impact piston 203 then no longer strikes the front impact face 205, but instead the rear impact face 206.

To change the position of the control bushing 104, a pressurized medium line 218 is provided which is routed inside the pressurized air supply line 211 to the ram boring device and extends in the ram boring device farther to the tip of the drill head 202. A connecting piece 219 supplies a fluid from the pressurized fluid line 218 to a ring-shaped pressure chamber 217 formed by the outside surface of the control tube 210 and an inside surface of the control bushing 204. The relative position of the control bushing 204 inside the casing 201 can be changed and fixed by way of the pressure in the pressure chamber 217 in conjunction with the counterpressure operating on the control bushing 204 inside the pressure chamber 212, as well as optionally in conjunction with a counterforce generated, for example, by a spring.

Like in the exemplary embodiment of FIGS. 1 and 2, a displacement of the control bushing 204 towards the rear end of the ram boring device causes the movement direction of the impact piston 203 to also reverse at a center position of the impact piston 203 that is displaced toward the rear. The impact piston 203 then travels a longer distance between the reversal point and the front impact face 205, thereby reducing the impact frequency of the impact piston 203.

If the control bushing 204 is moved sufficiently in the direction of the rear end of the ram boring device, then the control piston 203 strikes the rear impact face 206, while the front impact face 205 is no longer contacted during the forward stroke. This causes a reversal of the movement direction of the ram boring device, allowing it to be retrieved from the borehole when, for example, hitting an obstacle.

Figure 5:
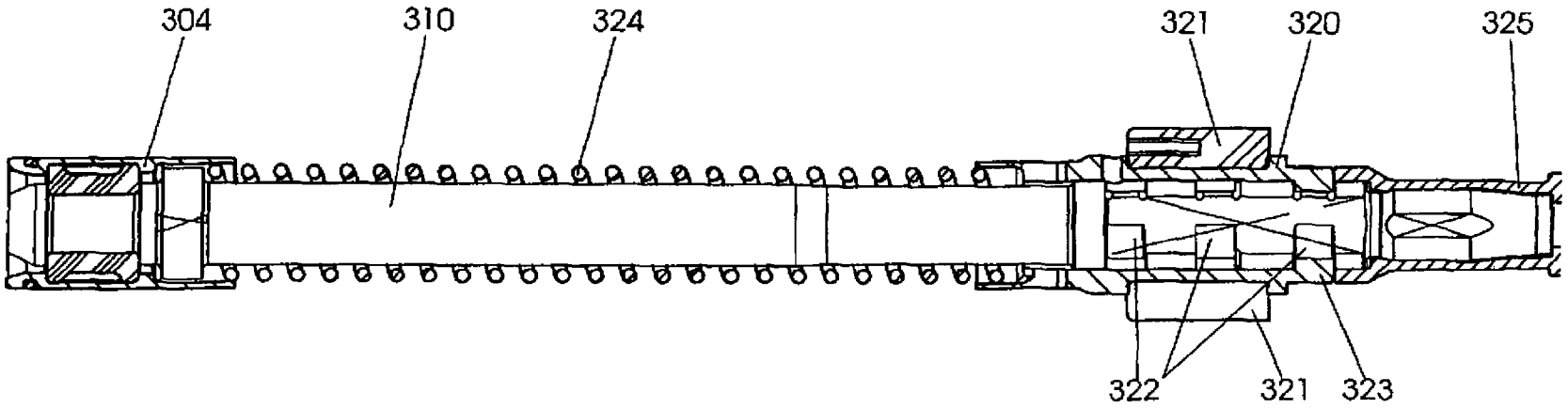
FIG. 5 the control elements of a ram boring device according to the invention in a fourth embodiment.

FIG. 5 shows an embodiment of a ram boring device according to the invention which is different from the aforedescribed embodiments in that the control bushing 304 is fixedly connected with the control tube 310, so that displacement of the control tube 310 inside the casing causes the entire control bushing and hence the center position of the impact piston to be displaced.

FIG. 5 shows only the control elements of the ram boring device; these can be combined, for example, with the additional components (in particular the casing, the impact piston, the drill head, etc.) of the ram boring device is illustrated in FIGS. 1 to 3.

The control tube 310 is movably supported inside a guide bushing 320 which is fixedly arranged in a rear section of the casing by way of elastic connecting elements 321. The control tube 310 forms three consecutive grooves 322, wherein depending on the longitudinal axial relative position of the control tube 310 in relation to the guide bushing 320 a protrusion 323 arranged on the inside of the guide bushing can engage in one of the grooves 322. The control tube 310 has in the section receiving the grooves 322 a cross-section which allows the protrusion 323 to engage in the grooves 322 at a specific relative rotational position of the control tube 310 with respect to the guide bushing 320 (locking position), thus preventing relative displacement in the longitudinal axial direction, and which prevents engagement of the protrusion 323 in one of the grooves 322 in at least one second relative rotational position (switching position) which is preferably offset by 90° with respect to the first position, thus enabling longitudinal axial relative movement. Suitable cross sections of the control tube 310 as well of the corresponding guide bushing 320 are disclosed in U.S. Pat. No. 5,148,878 A, in particular in FIGS. 3 to 5 and in the description in columns 4, lines 1 to 22; the disclosure of U.S. Pat. No. 5,148,878 A is incorporated by reference in the present written description.

The control tube 310 is pretensioned relative to the guide bushing 320 in both the longitudinal axial direction and in the rotation direction by a spring 324 secured between the guide bushing 320 and the front end of the control tube 310, such that the control tube 310 is moved forward (in FIG. 5 towards the left) relative to the guide bushing 320 and simultaneously moved into the locked position.

The control tube can be rotated from the locked position into the switching position by rotating a compressed air hose of the ram boring device, which is fixedly connected with the control tube by an adapter 325. If a high pressure were applied to the pressure chamber formed by the control tube 310 and the impact piston, this pressure which acts on the front faces of the control tube 310 and the connected control bushing 304 would then exceed the spring forces of the spring 324 and displace the control tube 310 together with the control bushing 304 rearward relative to the guide bushing 320 (in FIG. 5 to the right). It will be understood, that this may also be accomplished without applying pressure or by applying only a slight pressure by exerting pulling forces on the compressed air hose. When the rotational forces on the compressed air hose are released, the protrusion 323 of the guide bushing 320 could then engage in one of the front grooves 322, thereby changing compared to the first position either the frequency and intensity of the impact strikes on the front impact face or reversing the movement direction in that the impact piston then only strikes a rear impact face.

The control tube 310 in FIG. 5 is fixed in its most forward position; this corresponds to an engagement of the protrusion 323 with the groove 322 farthest to the rear. In this position, the control tube 310 and therefore also the control bushing are positioned as close as possible to the front impact face of the casing. This causes a short stroke of the impact piston with a relatively small intensity, but high impact frequency.

When the protrusion 323 engages in the center groove 322, the ram boring device is still in the advance position; however, the impact piston then performs at each impact cycle a longer stroke with greater intensity, because the control bushing and hence the center position of the impact piston are displaced toward the rear; at the same time, the impact frequency is reduced.

When the protrusion 323 engages in the front groove 322, the center position of the impact piston is displaced so far toward the rear that the impact piston no longer strikes the front impact face of the ram boring device, but strikes instead the rear impact face, thereby reversing the movement direction of the ram boring device.

The grooves 322 (in particular the two front grooves) may be oriented with respect to one another with a (rotational) offset, enabling step-wise switching between the various switching positions. In this way, unintentional switching directly from, for example, the rear groove into the front groove, which would cause the movement direction of the ram boring device to reverse, instead of a switchover between the two switching positions for the advance, can be prevented.

What is claimed is:

1. A ram boring device for creating horizontal boreholes, comprising: a casing having impact faces, an impact piston which is set in an oscillatory motion by a pressurized fluid and transfers kinetic energy to at least one of the impact faces, a device constructed to displace a center position of the impact piston longitudinally in the casing, with variation in one or both of a frequency of the impact motion and an impact intensity being responsive to displacement of the center position of the impact piston, wherein said device comprises:

a pressure chamber arranged between the casing and the impact piston;

a control bushing moveable inside the impact piston; and at least one control opening disposed in an envelope of the impact piston, wherein alternatingly positioning the at least one control opening in front and behind the control bushing causes the pressure chamber to be aerated and vented, and the center position of the impact piston being displaced by one or both of changing a length of the control bushing and shifting a position of the control bushing inside the casing.

2. The ram boring device of claim 1, further comprising a guide bushing arranged rearward inside the casing and connected with the control bushing, wherein the control bushing is displaced by a length change of the guide bushing or by a shift in a position of the guide bushing inside the casing.

3. The ram boring device of claim 1, further comprising a control tube and a guide bushing arranged rearward inside the casing and connected with the control bushing by way of the control tube, wherein the control bushing is displaced inside the casing by a relative displacement of the control tube with respect to the control bushing.

4. The ram boring device of claim 3, wherein the control bushing or the guide bushing comprises at least two partial bushings, which are arranged for relative movement at least in a longitudinal axial direction, with a relative position of the at least two partial bushings defining the length of the control bushing or of the guide bushing.

5. The ram boring device of claim 4, further comprising an adjustment device for changing the relative position of the at least two partial bushings.

6. The ram boring device of claim 5, further comprising elastic means arranged between the at least two partial bushings and producing a return force opposing an adjustment force produced by the adjustment device.

7. The ram boring device of claim 2, further comprising:

a control tube extending at least in a section inside the control bushing or inside the guide bushing and movable with respect to the section at least in a longitudinal axial direction, and adjusting means for adjusting the relative position between the control bushing or guide bushing and the control tube.

8. The ram boring device of claim 7, wherein the control tube is connected with the control bushing and movably supported inside the control bushing, said control tube configured to fix a relative position of the control tube in relation to the guide bushing in several positions.

9. The ram boring device of claim 8, further comprising elastic means for pretensioning the control tube with respect to the guide bushing in the longitudinal axial direction and in a rotation direction, with pretension in the longitudinal axial direction causing a forward displacement of the control bushing inside the casing and pretension in the rotation direction causes a locking element to engage in a corresponding undercut, thereby fixing the relative position of the control tube in relation to the guide bushing.

10. The ram boring device of claim 7, further comprising a second pressure chamber arranged between the control bushing or the guide bushing and the control tube, with a size of the second pressure chamber defining the relative position of the control bushing in relation to the control tube.

11. The ram boring device of claim 10, further comprising an additional supply line for supplying a pressurized fluid for pressurizing the second pressure chamber, wherein the additional supply line is independent of a supply line for supplying a drive fluid to the ram boring device.

12. A ram boring device for creating horizontal boreholes comprising:

a casing having impact faces;

an impact piston which is set in an oscillatory motion by a pressurized fluid and transfers kinetic energy to at least one of the impact faces;

a pressure chamber arranged between the casing and the impact piston;

a control bushing arranged for movement inside the impact piston; and at least two control openings disposed in an envelope of the impact piston with a mutual offset in a longitudinal direction of the impact piston, and a device for covering one of the control openings;

wherein alternatingly positioning the at least two control openings in front of and behind the control bushing causes the pressure chamber to be aerated and vented, and one or both of the frequency or the impact intensity is changed by changing one or both of a length of the control bushing or shifting a position of the control bushing inside the casing.

13. The ram boring device of claim 12, further comprising an additional bushing arranged inside the impact piston for movement in the longitudinal direction or for rotation, or both, and covering, depending on a position of the additional bushing inside the impact piston, none, one or several of the at least two control openings.

14. A method for operating a ram boring device, comprising the steps of:

imparting an oscillatory motion on an impact piston with a pressurized fluid, transferring at least a portion of kinetic energy of the impact piston to a casing of the ram boring device via one or several contact surfaces disposed in the casing, providing a pressure chamber between the casing of the ram boring device and the impact piston;

positioning a control bushing within the impact piston relative to at least one control opening in an envelope of the impact piston in fluid communication with the pressure chamber to displace a center position of the impact piston longitudinally inside the casing; and one or both of changing a length of the control bushing or shifting a position of the control bushing within the casing to change one or both of a frequency of the oscillatory motion or an impact intensity.

15. The method of claim 14, wherein the frequency or the impact intensity are changed during operation of the ram boring device commensurate with soil conditions.

* * * * *